US006727805B2

(12) United States Patent
Hollister et al.

(10) Patent No.: US 6,727,805 B2
(45) Date of Patent: Apr. 27, 2004

(54) SIGNALING RETENTION DEVICE

(75) Inventors: Ronald S. Hollister, Danbury, CT (US); Kenneth R. Altberg, Danbury, CT (US)

(73) Assignee: Fire Factory, LLC, Simsbury, CT (US)

( * ) Notice: Subject to any disclaimer, the term of this patent is extended or adjusted under 35 U.S.C. 154(b) by 0 days.

(21) Appl. No.: 10/143,960

(22) Filed: May 14, 2002

(65) Prior Publication Data

US 2003/0214390 A1 Nov. 20, 2003

(51) Int. Cl.[7] ..... G08B 27/00

(52) U.S. Cl. ..... 340/326; 340/321; 340/541; 340/546; 292/342; 292/343; 292/355

(58) Field of Search ..... 340/326, 541, 340/545.1, 545.8, 584, 870.17, 586, 815.83, 501, 517, 546, 321; 292/342, 343, 355

(56) References Cited

U.S. PATENT DOCUMENTS

| | | | | | |
|---|---|---|---|---|---|
| 3,432,843 | A | | 3/1969 | Spring | 340/546 |
| 4,090,185 | A | | 5/1978 | Patty | 340/321 |
| 4,284,981 | A | | 8/1981 | Black | 340/545 |
| 4,468,656 | A | | 8/1984 | Clifford et al. | 340/539 |
| 4,489,308 | A | | 12/1984 | Logan, Jr. et al. | 340/286 R |
| 4,501,444 | A | * | 2/1985 | Dominguez | 292/342 |
| 4,746,912 | A | | 5/1988 | Clifford et al. | 340/691 |
| 4,839,630 | A | | 6/1989 | Miller | 340/574 |
| 4,890,092 | A | | 12/1989 | Grimm | 340/546 |
| D306,409 | S | | 3/1990 | Fish | D10/106 |
| 4,959,637 | A | | 9/1990 | Woods et al. | 340/573 |
| 5,008,648 | A | * | 4/1991 | Conemac | 340/546 |
| 5,109,322 | A | | 4/1992 | Loughlin | 362/109 |
| D342,213 | S | | 12/1993 | Fellmann | D10/106 |
| D360,156 | S | | 7/1995 | Fenne | D10/106 |
| 5,447,347 | A | * | 9/1995 | Siddons | 292/342 |
| 5,697,656 | A | | 12/1997 | Hebert et al. | 292/343 |
| 5,755,582 | A | * | 5/1998 | Charlton | 439/131 |
| 5,757,273 | A | | 5/1998 | Crandall et al. | 340/573 |
| 5,825,280 | A | | 10/1998 | Merendini et al. | 340/326 |
| 5,850,172 | A | | 12/1998 | Lenz et al. | 340/384.1 |
| 5,898,363 | A | | 4/1999 | Altilio | 340/384.1 |
| 6,040,780 | A | | 3/2000 | Lucas | 340/691.1 |
| 6,060,982 | A | * | 5/2000 | Holtrop | 340/432 |
| 6,064,430 | A | * | 5/2000 | Lefkowitz | 348/151 |
| 6,114,948 | A | | 9/2000 | Astell | 340/332 |
| 6,133,839 | A | | 10/2000 | Ellul, Jr. et al. | 340/584 |
| 6,249,221 | B1 | | 6/2001 | Reed | 340/539 |
| 6,259,794 | B1 | * | 7/2001 | Dobbins | 381/124 |
| 6,317,047 | B1 | * | 11/2001 | Stein et al. | 340/573.1 |

FOREIGN PATENT DOCUMENTS

JP 2001-054452 * 8/1999

OTHER PUBLICATIONS

Internet Site by Open Door Industries at http://www-.wedgeit.com entitled "Wedge–It", Mar. 28, 2002.

* cited by examiner

*Primary Examiner*—Daniel J. Wu
*Assistant Examiner*—Son Tang
(74) *Attorney, Agent, or Firm*—Richard C. Litman

(57) ABSTRACT

A signaling retention device that is configured to retain an element in a particular position and to emit an audible and/or visual signal. The signaling retention device may include a power source, memory, a central processing unit (CPU), sensor(s), audible indicator(s), light source(s), switch(es), camera(s), a transceiver, a microphone, impact tool(s), and aromatic element(s) and may be configured in the form of a character, such as a cartoon character or the like. The power source may be any suitable power source, such one or more batteries (rechargeable or non-rechargeable) or the like, and may be removable or non-removable. Similarly, the memory, CPU, audible indicator(s), light source(s), switch (es), camera(s), transceiver, microphone, impact tool(s), and aromatic element (s) may be any types well known in the art.

20 Claims, 9 Drawing Sheets

SIGNALING RETENTION DEVICE

BACKGROUND OF THE INVENTION

1. Field of the Invention

The present invention relates to signaling devices and more particularly to signaling devices configured to retain elements, such as doors, windows, wheels, or the like, in a particular position, and to emit visual and/or audible signals.

2. Description of the Related Art

Emergency service personnel such as firefighters, policeman, etc., are often confronted with unpredictable situations, such as residential and commercial fires, elevator emergencies, car fires, lockouts, vehicle extrication's, etc. Many situations require the stabilization and securing of devices such as doors, windows, elevators, voids, or the like. Typically, elements like door wedges are used to secure doors and windows in an open position. However, during emergency situations, the environment may be dark or smoky and doors that have been secured in an open position by a door wedge may be difficult to locate. In addition, a door wedge is one of a number of tools that emergency service personnel may be required to carry, and can result in inefficient use of time due to searching time required to locate a particular tool. Therefore, a need exists for a signaling retention device configured to retain devices in a particular position and to emit visual and/or audible signals.

The related art is represented by the following references of interest.

U.S. Design Pat. No. 306,409, issued on Mar. 6, 1990 to Darrell Fish, shows an ornamental design for a smoke detector. Fish does not suggest a signaling retention device according to the claimed invention.

U.S. Design Pat. No. 342,213, issued on Dec. 14, 1993 to Hansruedi Fellmann, shows an ornamental design for a fire detector. Fellmann does not suggest a signaling retention device according to the claimed invention.

U.S. Design Pat. No. 360,156, issued on Jul. 11, 1995 to Kenneth R. Fenne, shows an ornamental design for a combined strobe light and smoke detector for the hearing impaired. Fenne does not suggest a signaling retention device according to the claimed invention.

U.S. Pat. No. 3,432,843, issued on Mar. 11, 1969 to Claude L. Spring, describes a spherical signal means that is designed to be energized by the unauthorized opening or passage through a door, window or the like. Spring does not suggest a signaling retention device according to the claimed invention.

U.S. Pat. No. 4,090,185, issued on May 16, 1978 to Richard L. Patty, describes a self contained emergency signaling device. Patty does not suggest a signaling retention device according to the claimed invention.

U.S. Pat. No. 4,284,981, issued on Aug. 18, 1981 to Robert B. Black, describes a sensor alarm including a sensor for detecting heat, smoke, noxious gases, and the like and an alarm for warning of an alarm condition coupled to the sensor. Black does not suggest a signaling retention device according to the claimed invention.

U.S. Pat. No. 4,468,656, issued on Aug. 28, 1984 to Thomas J. Clifford et al., describes an emergency signaling unit and alarm system for rescuing endangered workers. Clifford et al. '656 does not suggest a signaling retention device according to the claimed invention.

U.S. Pat. No. 4,489,308, issued on Dec. 18, 1984 to Emanuel L. Logan, Jr. et al., describes a system for identifying emergency exits in a building that includes a strobe light which is tethered at an elevated location with respect to the floor of the building. Logan, Jr. et al. does not suggest a signaling retention device according to the claimed invention.

U.S. Pat. No. 4,746,912, issued on May 24, 1988 to Thomas Clifford et al., describes an alarm signaling method and system utilizing cross cueing between radio, audio and visible alarm signals which are emitted by an alarm signaling unit. Clifford et al. '912 does not suggest a signaling retention device according to the claimed invention.

U.S. Pat. No. 4,839,630, issued on Jun. 13, 1989 to Robert A. Miller, describes an emergency signal system for individual mobile homes. Miller does not suggest a signaling retention device according to the claimed invention.

U.S. Pat. No. 4,890,092, issued on Dec. 26, 1989 to Virgil A. Grimm, describes a wedge-shaped door stop alarm. Grimm does not suggest a signaling retention device according to the claimed invention.

U.S. Pat. No. 4,959,637, issued on Sep. 25, 1990 to Richard E. Woods et al., describes an emergency signaling device. Woods et al. does not suggest a signaling retention device according to the claimed invention.

U.S. Pat. No. 5,008,648, issued on Apr. 16, 1991 to Timothy D. Conemac, describes an electronic door wedge alarm. Conemac does not suggest a signaling retention device according to the claimed invention.

U.S. Pat. No. 5,697,656, issued on Dec. 16, 1997 to Robert J. Hebert et al., describes a door stop assembly. Hebert et al. does not suggest a signaling retention device according to the claimed invention.

U.S. Pat. No. 5,757,273, issued on May 26, 1998 to Mark Crandall et al., describes a multifunctional personal alert safety system. Crandall et al. does not suggest a signaling retention device according to the claimed invention.

U.S. Pat. No. 5,825,280, issued on Oct. 20, 1998 to Andrew V. Merendini et al., describes a portable safety light and audible signal apparatus for placement in proximity to a building exit. Merendini et al. does not suggest a signaling retention device according to the claimed invention.

U.S. Pat. No. 5,850,172, issued on Dec. 15, 1998 to Vernon C. Lenz et al., describes an emergency service rescue marker. Lenz et al. does not suggest a signaling retention device according to the claimed invention.

U.S. Pat. No. 5,898,363, issued on Apr. 27, 1999 to Michael T. Altilio, describes a portable audible beacon. Altilio does not suggest a signaling retention device according to the claimed invention.

U.S. Pat. No. 6,040,780, issued on Mar. 21, 2000 to Michael Lucas, describes a child's personal security assistant. Lucas does not suggest a signaling retention device according to the claimed invention.

U.S. Pat. No. 6,114,948, issued on Sep. 5, 2000 to Benjamin F. Astell, describes a safety apparatus for providing information to a fire fighter. Astell does not suggest a signaling retention device according to the claimed invention.

U.S. Pat. No. 6,133,839, issued on Oct. 17, 2000 to Joseph A. Ellul, Jr. et al, describes a smoke detector apparatus with an emergency escape indicator. Ellul, Jr. et al. does not suggest a signaling retention device according to the claimed invention.

U.S. Pat. No. 6,249,221 B1, issued on Jun. 19, 2001 to Joyce J. Reed, describes an emergency detector door illumination escape system. Reed does not suggest a signaling retention device according to the claimed invention.

U.S. Pat. No. 6,317,047 B1, issued on Nov. 13, 2001 to Michael Stein et al., describes a fire fighter's safety device. Stein et al. does not suggest a signaling retention device according to the claimed invention.

An Internet site entitled "Wedge-It" for Open Door Industries at http:\\www.wedgeit.com, printed on Mar. 28, 2002, describes a portable, temporary, light weight door stop for emergency service personnel.

None of the above inventions and patents, taken either singularly or in combination, is seen to describe the instant invention as claimed.

SUMMARY OF THE INVENTION

The present invention is a signaling retention device that is configured to retain an element in a particular position and to emit an audible and/or visual signal.

The signaling retention device may include a power source, memory, a central processing unit (CPU), sensor(s), audible indicator(s), light source(s), switch(es), camera(s), a transceiver, a microphone, impact tool(s), and aromatic element(s) and may be configured in the form of a character, such as a cartoon character or the like. The power source may be any suitable power source, such one or more batteries (rechargeable or non-rechargeable) or the like, and may be removable or non-removable. Similarly, the memory, CPU, audible indicator(s), light source(s), switch (es), camera(s), transceiver, microphone, impact tool(s), and aromatic element(s) may be any types well known in the art. The signaling retention device may be intrinsically safe.

Accordingly, it is a principal aspect of the invention to provide a signaling retention device that is configured to retain an element in a particular position and to emit an audible and/or visual signal.

It is another aspect of the invention to provide a signaling retention device that includes a power source, memory, a CPU, sensor(s), audible indicator(s), light source(s), switch (es), camera(s), a transceiver, a microphone, impact tool(s), and aromatic element(s), and is configured in the form of a character.

It is an aspect of the invention to provide improved elements and arrangements thereof for the purposes described which is inexpensive, dependable and fully effective in accomplishing its intended purposes.

These and other aspects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
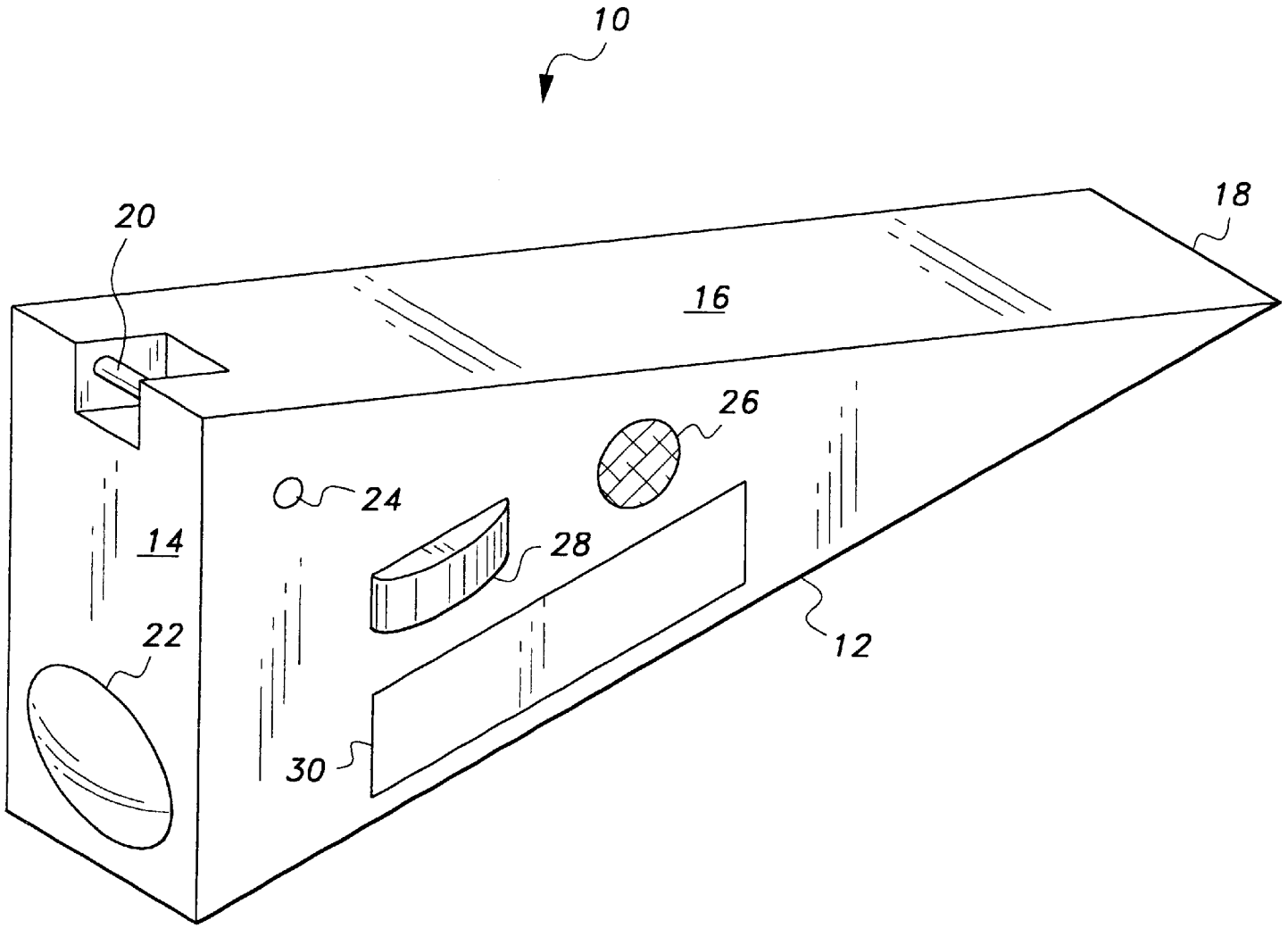
FIG. 1 is a side, perspective view of a signaling retention device according to the present invention.

The present invention is a signaling retention device. The invention disclosed herein is, of course, susceptible of embodiment in many different forms. Shown in the drawings and described hereinbelow in detail is are preferred embodiments of the invention. It is to be understood, however, that the present disclosure is an exemplification of the principles of the invention and does not limit the invention to the illustrated embodiments.

Referring to the drawings, FIG. 1 generally illustrates one example of a signaling retention device according to the invention. Signaling retention device 10 is generally configured in the form of a door wedge, e.g., device 10 is triangular in shape and includes a faceplate, a first side 12, a second side 14, a third side 16, and a backplate. Second side 14 is perpendicular to first side 12. Third side 16 tapers toward tip 18. Signaling retention device 10 is configured to retain a door in an open position, and is preferably manufactured from a durable, lightweight material, such as polycarbonate plastic or the like. However, any desirable durable material may be used, such as metal, wood, or the like. First side 12 may have a non-slip surface to inhibit movement of signaling retention device 10. The material used for signaling retention device 10 may be opaque or translucent and may be colored according to the desires of the user. For example, signaling retention device 10 may be brightly, fluorescently colored to make it easy to identify work areas, points of egress, or to lead a trail to and from search areas.

Signaling retention device 10 includes clip element 20 to enable a user to secure device 10 to a holding element, such as a belt or the like. Signaling retention device 10 also includes light source 22, light source 24, audible indicator 26, switch 28, and power source 30. Although not shown in the drawings, signaling retention device 10 may also include a CPU, memory, one or more sensors, one or more cameras, a transceiver, a microphone, etc. In addition, signaling retention device 10 may include one or more impact tools, one or more aromatic elements, and may be configured in the form of a character, such as a cartoon character or the like.

Light source 22 may be configured as a flashlight that includes a bulb and a reflector for illuminating an area. Light source 24 may be a strobe light, such as a xenon bulb or the like, that periodically emits a bright light. Signaling retention device 10 may be configured to emit light source 24 out of any or all sides of device 10. Audible indicator 26 may be a speaker that is powered by an amplifier to emit any distinctive audible sound, such as a buzzer, chirp, chime, or the like. Alternatively, audible indicator 26 may be a speaker that relays any audible communication information, such a recordered message, a relayed communication message, a relayed live transmission, or the like. Switch 28 may be configured to activate and deactivate light source 22, light source 24, and/or audible indicator 26 by any well known technique, such as depressing, rocking, rotating, or the like. Power source 30 may be any suitable power source, such one or more batteries (rechargeable or non-rechargeable) or the like, and may be removable or non-removable.

As described above, signaling retention device 10 may also include a CPU and memory. A CPU would be connected to all of the electrical elements on signaling retention device 10 and would control the movement and process of instructions as well as data in device 10. A memory would store instructions and data as CPU processed information. Signaling retention device 10 may also include one or more sensors to detect any desirable condition, such as movement, temperature, smoke, carbon monoxide, or the like. Signaling retention device may also include one or more cameras, a transceiver, a microphone, etc. These elements may be of any type well known in the art. The camera may be a digital camera that converts a captured image into a digital bit stream for storage or transmission. The transceiver can establish two-way communication between signaling retention device 10 and a telephone line by way of an antenna. The microphone may be used for relaying audio data or for activating one of the indicators on device 10 by any well known voice activation technique.

Signaling retention device 10 can be configured to establish two-way communication through the combined use of the microphone and audible indicator 26. In addition, signaling retention device 10 may include one or more impact tools, one or more aromatic elements, and may be configured in the form of a character, such as a cartoon character or the like. An impact tool may be a spring-loaded center punch or the like. An aromatic element may be provided to emanate a pleasant scent from signaling retention device 10, and may be a scented or aromatic material, such as basil, cinnamon, clove eucalyptus, juniper, lavender, lemon, lime, mint, orange, rose, rosemary, vanilla or the like.

Figure 2:
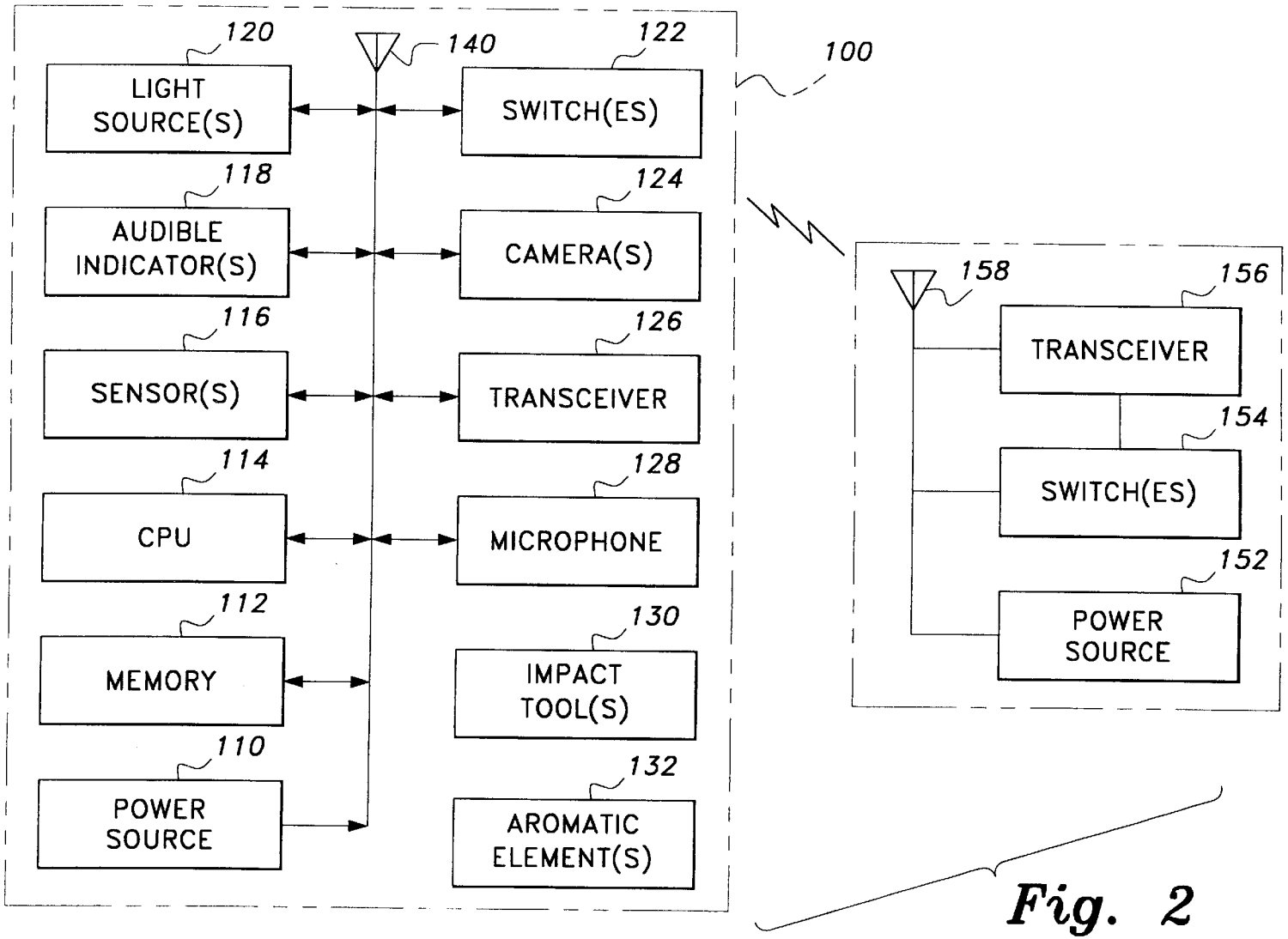
FIG. 2 is a block diagram a signaling retention device according to the present invention.

FIG. 2 generally illustrates a block diagram of a signaling retention device according to the invention. Signaling retention device 100 includes power source 110, memory 112, CPU 114, sensor(s) 116, audible indicator(s) 118, light source(s) 120, switch(es) 122, camera(s) 124, transceiver 126, microphone 128, impact tool(s) 130, and aromatic element(s) 132. As described above, power source 110 may be any suitable power source, such one or more batteries (rechargeable or non-rechargeable) or the like, and may be removable or non-removable. Similarly, memory 112, CPU 114, audible indicator(s) 118, light source(s) 120, switch(es) 122, camera(s) 124, transceiver 126, microphone 128, impact tool(s) 130, and aromatic element(s) may be any types well known in the art.

Figure 3A:
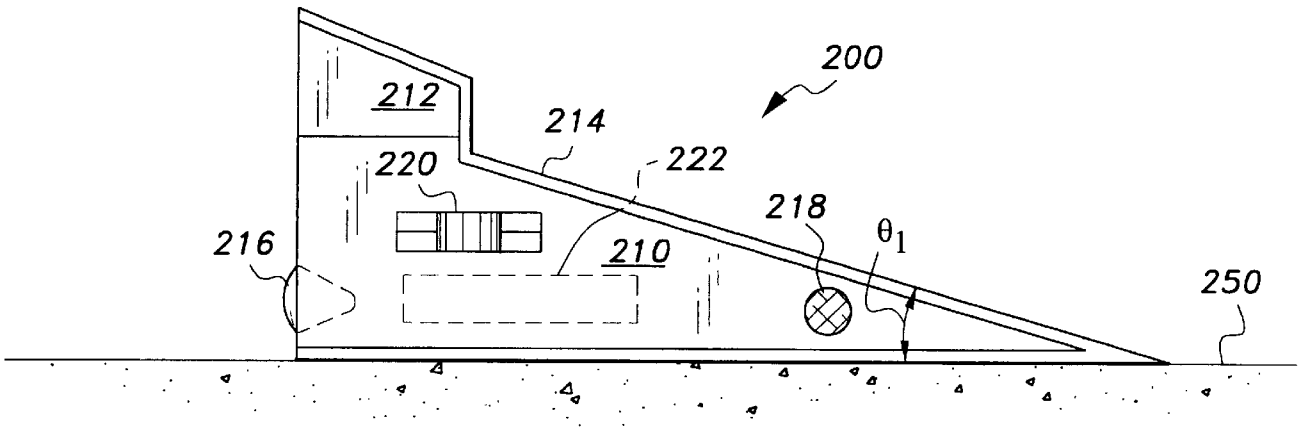
FIG. 3A is a side view of a signaling retention device according to the present invention.
Figure 3B:
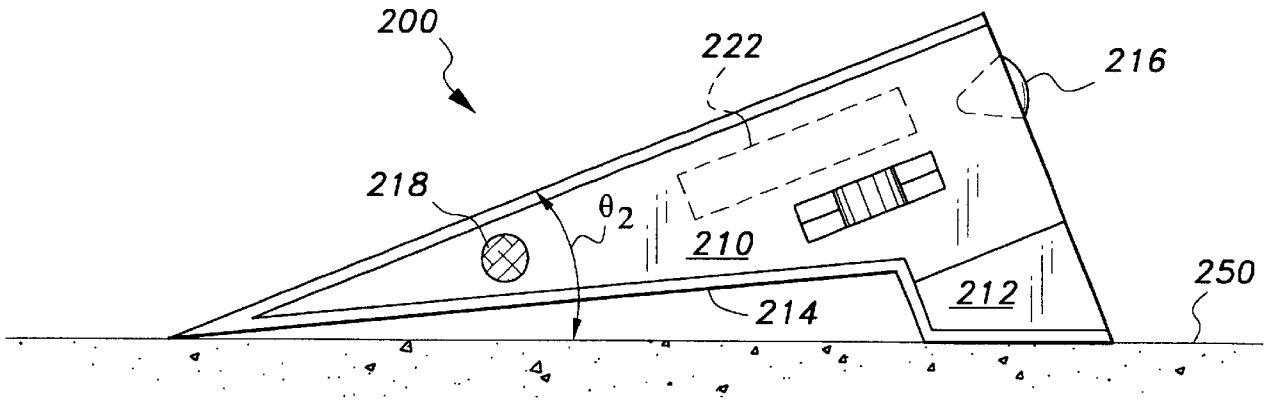
FIG. 3B is a side view of a signaling retention device according to the present invention.

FIGS. 3A and 3B generally illustrate another example of a signaling retention device according to the invention. Signaling retention device 200 is generally configured in the form of a door wedge, e.g., device 200 is triangular in shape and includes a faceplate 210, a first side, a second side, a third side, a fourth side, a fifth side 214, and a backplate. The second side is perpendicular to first side. The third side tapers toward the fourth side which is parallel to the first side. Finally, fifth side 214 tapers towards the tip of device 200. Signaling retention device is configured to enable a user to engage a door with two different angles $\theta 1$ and $\theta 2$, by rotating device 200. If a user desires a smaller angle, device 200 is configured as shown in FIG. 3A for $\theta 1$, and if a user desires a larger angle, device 200 is configured as shown in FIG. 3B for $\theta 2$. Signaling retention device 200 is preferably manufactured from a durable, lightweight material, such as polycarbonate plastic or the like. However, any desirable durable material may be used, such as metal, wood, or the like. The first and third sides may have a non-slip surface to inhibit movement of signaling retention device 200. The material used for signaling retention device 200 may be opaque or translucent and may be colored according to the desires of the user.

Signaling retention device 200 includes light source 216, audible indicator 218, switch 220, and power source 222. Although not shown in the drawings, signaling retention device 200 may also include a CPU, memory, one or more sensors, one or more cameras, a transceiver, a microphone, etc. In addition, signaling retention device 200 may include one or more impact tools, one or more aromatic elements, and may be configured in the form of a character, such as a cartoon character or the like.

Light source 216 may be configured as a flashlight that includes a bulb and a reflector for illuminating an area. Audible indicator 218 may be a speaker that is powered by an amplifier to emit a distinctive audible sound that periodically repeats. Alternatively, audible indicator 218 may be a speaker that relays audible communication information from a remote source (not shown). Switch 220 may be configured to activate and deactivate light source 216 and/or audible indicator 218 by any well known technique, such as depressing, rocking, rotating, or the like. Power source 222 may be any suitable power source, such one or more batteries (rechargeable or non-rechargeable) or the like, and may be removable or non-removable.

As described above, signaling retention device 200 may also include a CPU and memory. A CPU would be connected to all of the electrical elements on signaling retention device 200 and would control the movement and process of instructions as well as data in device 200. A memory would store instructions and data as CPU processed information. Signaling retention device 200 may also include one or more sensors to detect any desirable condition, such as movement, temperature, smoke, carbon monoxide, or the like. Signaling retention device may also include one or more cameras, a transceiver, a microphone, etc. These elements may be of any type well known in the art. The camera may be a digital camera that converts a captured image into a digital bit stream for storage or transmission. The transceiver can establish two-way communication between signaling retention device 200 and a telephone line by way of an antenna. The microphone may be used for relaying audio data or for activating one of the indicators on device 200 by any well known voice activation technique.

Signaling retention device 200 can be configured to establish two-way communication through the combined use of the microphone and audible indicator 218. In addition, signaling retention device 200 may include one or more impact tools, one or more aromatic elements, and may be configured in the form of a character, such as a cartoon character or the like. An impact tool may be a spring-loaded center punch or the like. An aromatic element may be provided to emanate a pleasant scent from signaling retention device 200, and may be a scented or aromatic material, such as basil, cinnamon, clove eucalyptus, juniper, lavender, lemon, lime, mint, orange, rose, rosemary, vanilla or the like.

Figure 4:
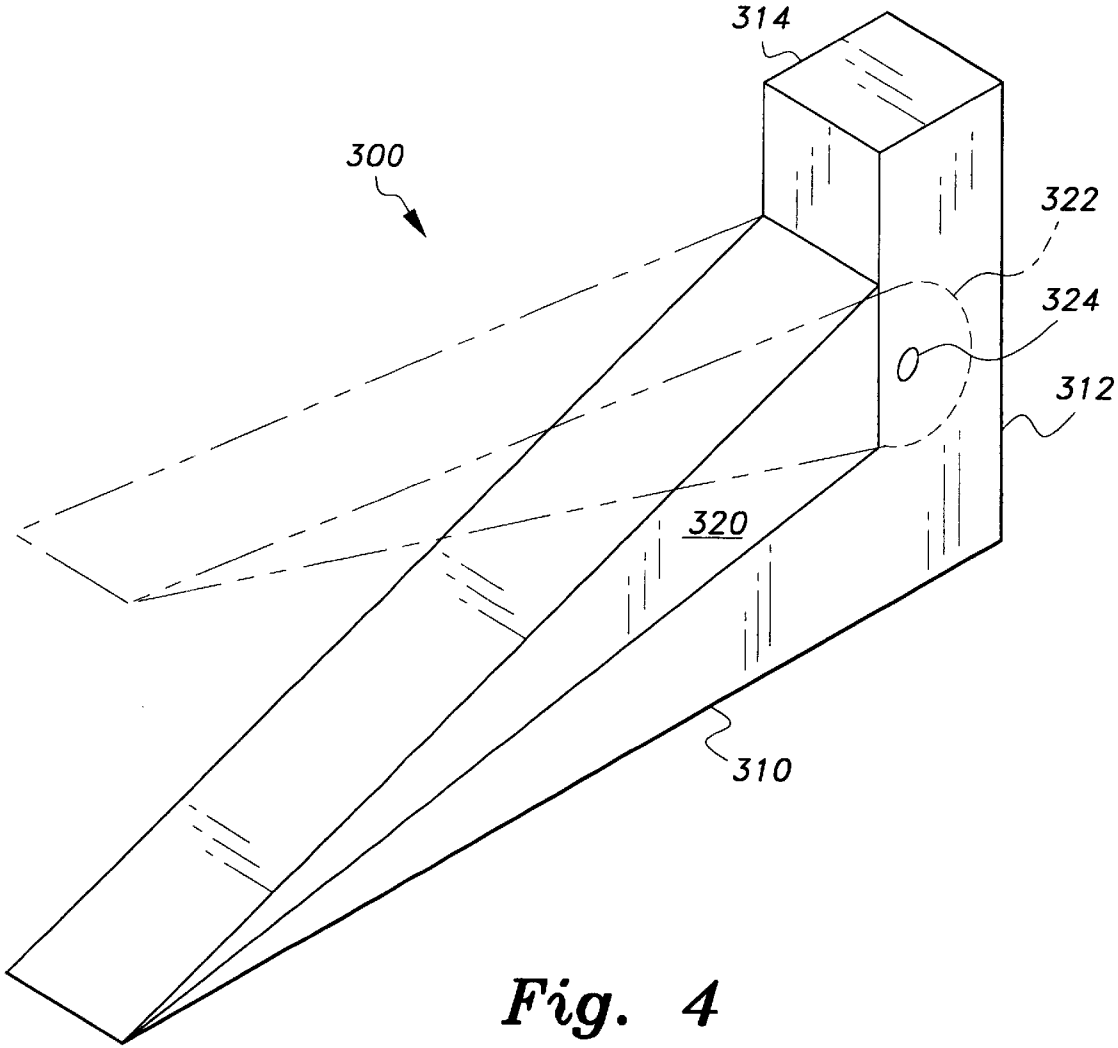
FIG. 4 is a side view of a signaling retention device according to the present invention.

FIG. 4 generally illustrates a signaling retention device 300 that includes a pivotable triangular element 320. Signaling retention device 300 also includes a first side 310, a second side 312, and a top 314. Triangular element 320 includes a circular portion 322 and is pivotally hinged about element 324 to enable a user to use device as jaws for any desired purpose. As described above for the other signal retention device examples, signaling retention device 300 may include a power source, a memory, a CPU, sensor(s), audible indicator(s), light source(s), switch(es), camera(s), a transceiver, a microphone, impact tool(s), and aromatic element(s). As described above, the power source may be any suitable power source, such one or more batteries (rechargeable or non-rechargeable) or the like, and may be removable or non-removable. Similarly, the memory, CPU, audible indicator(s), light source(s), switch(es), camera(s), transceiver, microphone, impact tool(s), and aromatic element(s) may be any types well known in the art.

Figure 5:
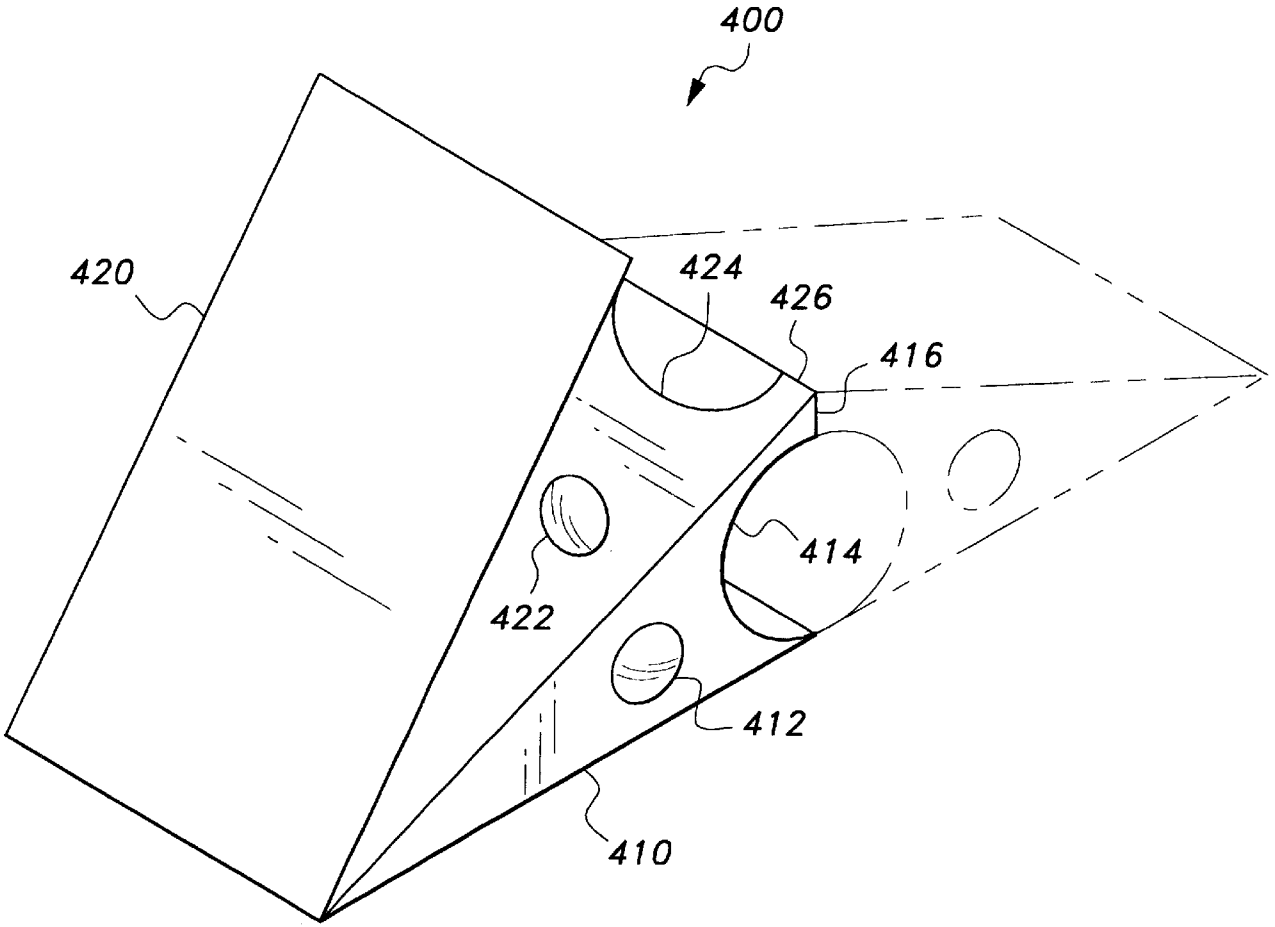
FIG. 5 is a side, perspective view of a signaling retention device according to the present invention.

FIG. 5 generally illustrates a signaling retention device 400 that may be an integrated unit or may be two independent signaling retention devices 410 and 420. For example, signaling retention unit 420 may be pivotally hinged to signaling retention device 410 about portions 426 and 416, respectively. Alternatively, signaling retention devices 410 and 420 may be two independent devices. includes a pivotable triangular element 420. Signaling retention devices 410 and 420 are each configured to enable a user to provide each device on one side of a hose that will allow transport of devices, such as carts or the like over a bridge formed by the two devices 410 and 420. As described above for the other signal retention device examples, signaling retention device 400 may include a power source, a memory, a CPU, sensor(s), audible indicator(s), light source(s), switch(es), camera(s), a transceiver, a microphone, impact tool(s), and aromatic element(s). As described above, the power source may be any suitable power source, such one or more batteries (rechargeable or non-rechargeable) or the like, and may be removable or non-removable. Similarly, the memory, CPU, audible indicator(s), light source(s), switch (es), camera(s), transceiver, microphone, impact tool (s), and aromatic element (s) may be any types well known in the art.

Figure 6:
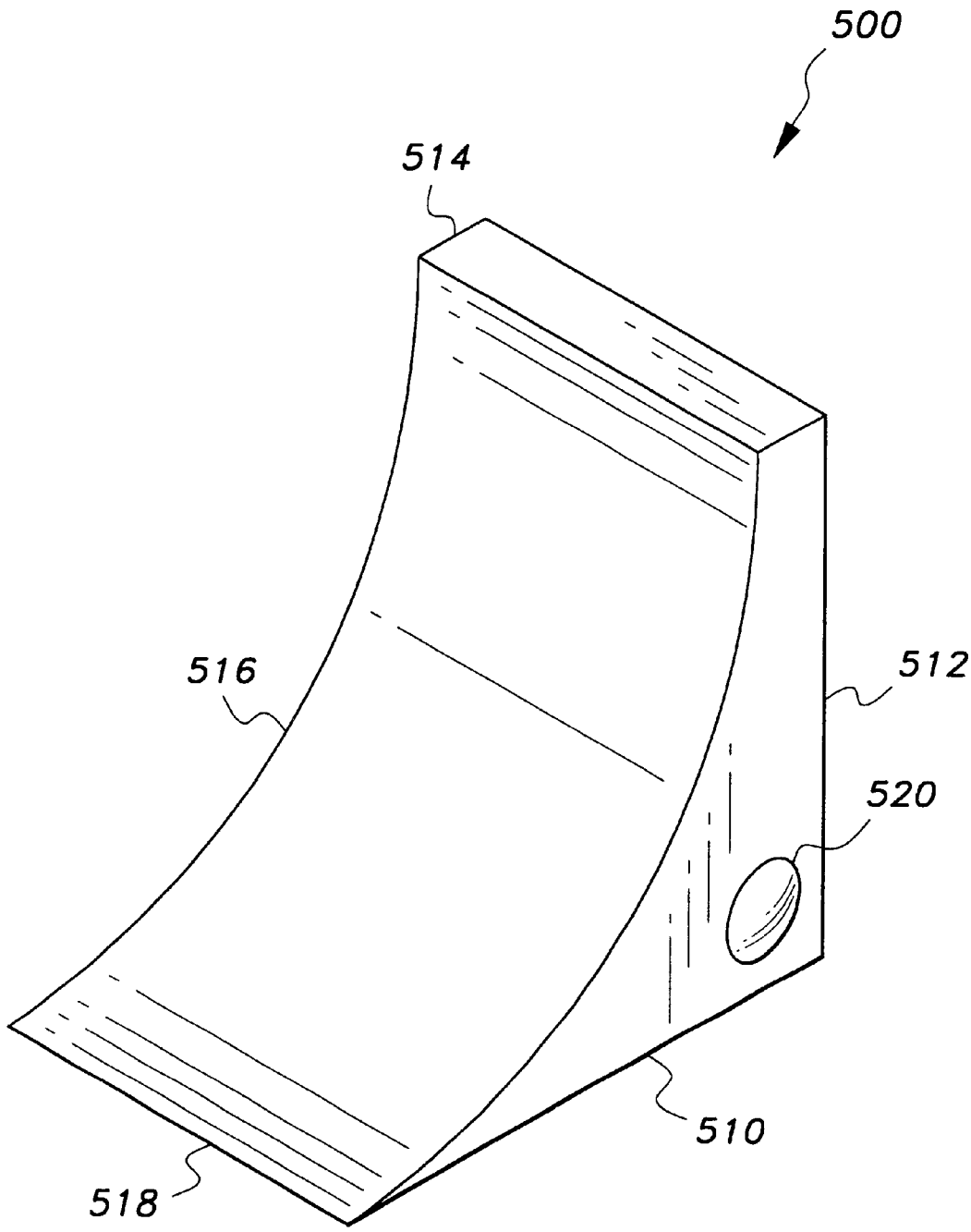
FIG. 6 is a side, perspective view of a signaling retention device according to the present invention.

FIG. 6 generally illustrates a signaling retention device 500 that is configured in the form of a wheel chock to retain a wheeled device in position. Signaling retention device 500 may be configured in the form of any type of wheel chock for retaining any type of wheel, such as land based wheels, air based wheels, rail, etc. Signaling retention device 500 includes a first side 510, a second side 512, a top 514, a circular side 516, and a tip 518. Signaling retention device 500 also includes a light source 520 that may be any well known type of light source. As described above for the other signal retention device examples, signaling retention device 500 may include a power source, a memory, a CPU, sensor (s), audible indicator(s), switch(es), camera(s), a transceiver, a microphone, impact tool (s), and aromatic element (s). As described above, the power source may be any suitable power source, such one or more batteries (rechargeable or non-rechargeable) or the like, and may be removable or non-removable. Similarly, the memory, CPU, audible indicator(s), light source(s), switch(es), camera(s), transceiver, microphone, impact tool(s), and aromatic element(s) may be any types well known in the art.

Figure 7A:
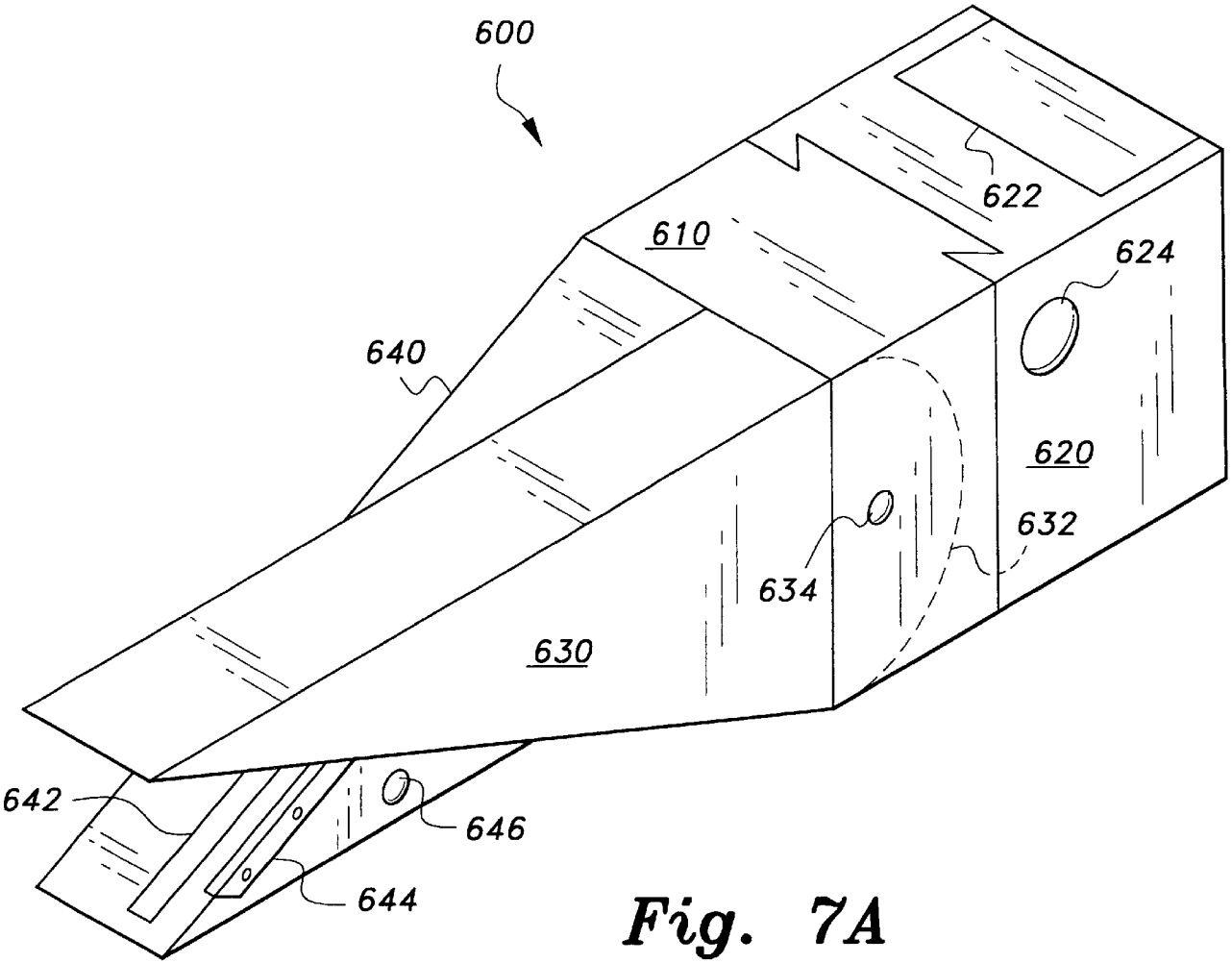
FIG. 7A is a side, perspective view of a signaling retention device according to the present invention.
Figure 7B:
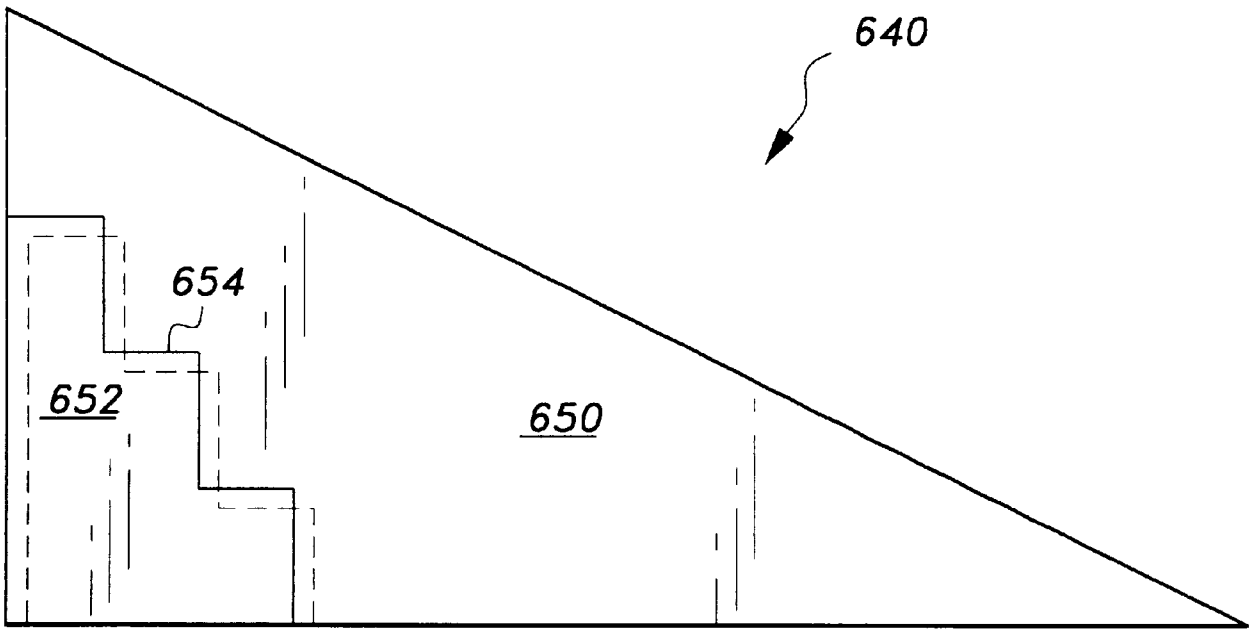
FIG. 7B is a side view of the signaling retention device shown in FIG. 7A.

FIGS. 7A and 7B generally illustrate a signaling retention device 600 that is configured in the form of a door wedge with a cutting tool to enable a user to cut items. Signaling retention device 600 includes a pivotable triangular element 630 and a fixed triangular element 640. Pivotable triangular element 630 includes a circular end 632 that pivots about hinge 634. Fixed triangular element 640 includes a locking element 646 that locks pivotable element 630 in position when element 630 is pivoted downwardly. Fixed element 640 also includes a lighted strip of fluorescent optics 642 and a cutting edge 644. As shown in FIG. 7B, fixed triangular element 640 includes a stepped element 652 that enables a user to wedge a device, such as a valve or the like. Signaling retention device 600 includes a removable element 620 that has mounted therein a light source 624 and a power source 622. Light source 624 may be any well known type of light source. Power source 622 may be any suitable power source, such one or more batteries (rechargeable or non-rechargeable) or the like, and may be removable or non-removable. As described above for the other signal retention device examples, signaling retention device 500 may also include a memory, a CPU, sensor(s), audible indicator(s), switch(es), camera(s), a transceiver, a microphone, impact tool(s), and aromatic element(s). Similarly, the memory, CPU, sensor(s), audible indicator(s), switch(es), camera(s), transceiver, microphone, impact tool(s), and aromatic element(s) may be any types well known in the art.

Figure 8B:
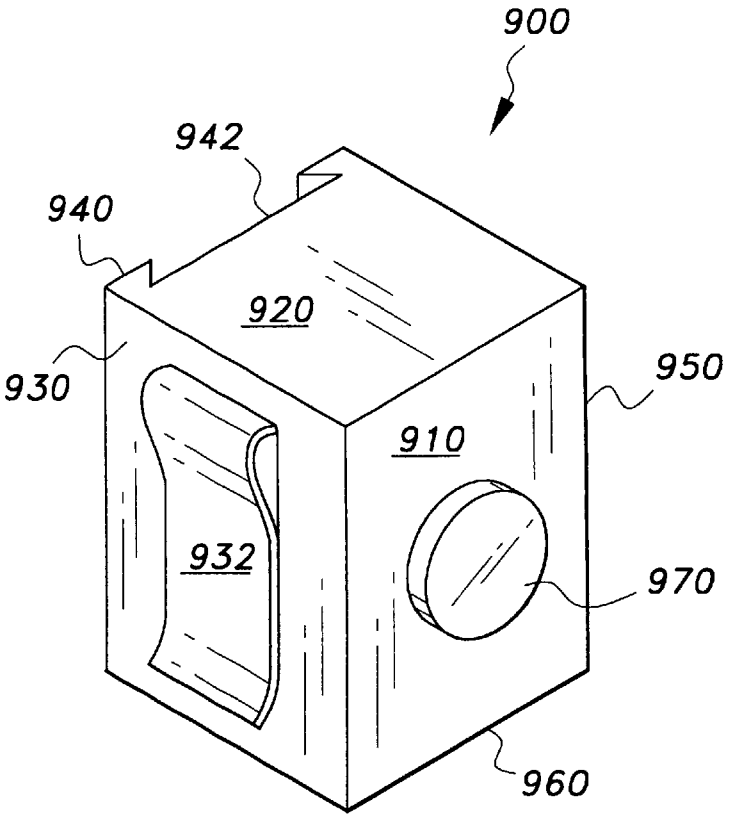
FIG. 8B is a side, perspective view of an end power element of a signaling retention device according to the present invention.
Figure 8A:
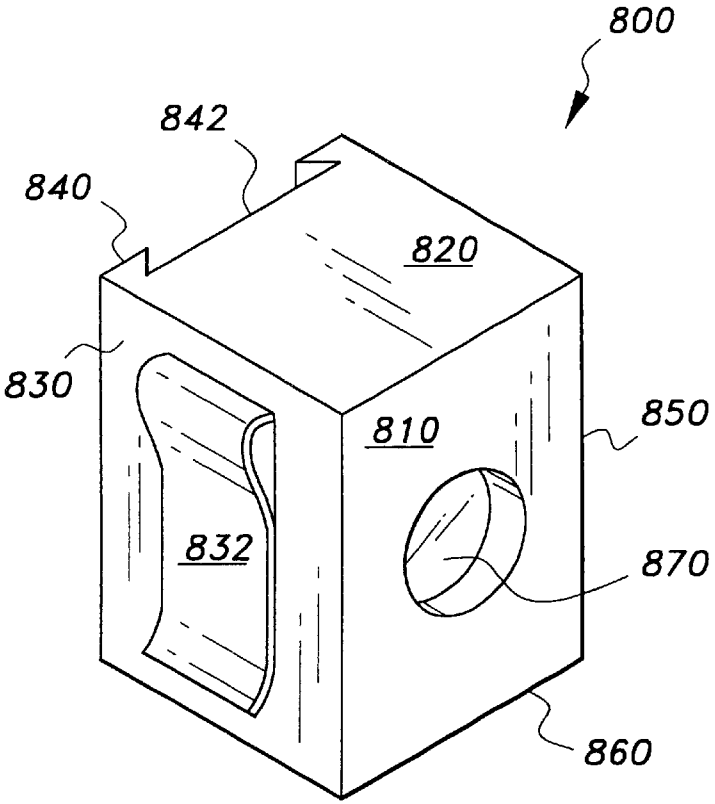
FIG. 8A is a side, perspective view of an end power element of a signaling retention device according to the present invention.

FIGS. 8A and 8B generally illustrate removable elements 800 and 900 configured for use with a signaling retention device as shown in FIG. 7A. Removable element 800 includes surfaces 810, 820, 830, and 840. Surface 810 includes a light recessed light source 870 that may be any well known type of light source. Surface 830 includes a clip element 832 that enables a user to clip the device on a belt or the like. Clip element 832 may be any type of clip device, such as a snap, a swivel, or the like. Surface 840 includes a recess 842 to engages with a signaling retention device. Removable element 900 includes surfaces 910, 920, 930, and 940. Surface 910 includes a protruding light source 970 that may be any well known type of light source. Surface 930 includes a clip element 932 that enables a user to clip the device on a belt or the like. Surface 940 includes a recess 942 to engage with a signaling retention device. Removable elements 800 and 900 also include a power source that may be any suitable power source, such one or more batteries (rechargeable or non-rechargeable) or the like, and may be removable or non-removable. As described above for the other signal retention device examples, removable elements 800 and 900 may also include a memory, a CPU, sensor(s), audible indicator(s), switch(es), camera(s), a transceiver, a microphone, impact tool(s), and aromatic element(s). Similarly, the memory, CPU, sensor(s), audible indicator(s), switch(es), camera(s), transceiver, microphone, impact tool (s), and aromatic element(s) may be any types well known in the art.

While the invention has been described with references to its preferred embodiments, it will be understood by those skilled in the art that various changes may be made and equivalents may be substituted for elements thereof without departing from the true spirit and scope of the invention.

We claim:

1. A signaling retention device comprising:

a faceplate and a backplate that are substantially parallel to and spaced from each other and are interconnected with substantially perpendicular first, second, third, fourth, and fifth sides, said first side interconnecting said second and fifth sides and being substantially perpendicular to said second side, said second side interconnecting said first and third sides and being substantially parallel to said fourth side, said third side interconnecting said second and fourth sides and tapering toward said fourth side, said fourth side interconnecting said third and fifth sides, said fifth side tapering toward and forming a tip with said first side, and a first angle defined by lines extending from the tip along the first and fifth sides being smaller than a second angle defined by lines extending from the tip along the first and third sides;

at least one signaling device configured to emit at least one of an audible signal and a visual signal; and a power source, wherein said signaling retention device is configured to retain an element in a particular position by engaging a base of said element with the fifth side by effecting the first angle, or by engaging a base of said element with the first side by effecting the second angle.

2. The signaling retention device according to claim 1, wherein said at least one signaling device includes a light source.

3. The signaling retention device according to claim 1, further comprising memory and a central processing unit.

4. The signaling retention device according to claim 1, further comprising at least one sensor.

5. The signaling retention device according to claim 1, further comprising at least one switch.

6. The signaling retention device according to claim 1, further comprising at least one camera.

7. The signaling retention device according to claim 1, further comprising a transceiver.

8. The signaling retention device according to claim 1, further comprising a microphone.

9. The signaling retention device according to claim 1, further comprising at least one impact tool.

10. The signaling retention device according to claim 1, further comprising at least one aromatic element.

11. A signaling retention device comprising:

a first member having a faceplate, a backplate, first and second sides, a first end, and a pivoting area in said third end, said faceplate and backplate of said first member being substantially parallel to and spaced from each other and being interconnected with said first and second sides, said first end interconnecting said first and second sides, said second side tapering toward and forming a tip with said first side, and said faceplate having a cutting blade proximate an edge of said second side;

a second member having a faceplate, a backplate, third and fourth sides, and a circular pivoting end, said faceplate and backplate of said second member being substantially parallel to and spaced from each other and being interconnected with said third and fourth sides, said circular pivoting end interconnecting said third and fourth sides, said third side tapering toward and forming a tip with said fourth side, and said circular pivoting end of said second member being pivotally interconnected with said pivoting area of said first member;

at least one signaling device configured to emit at least one of an audible signal and a visual signal; and a power source, wherein said signaling retention device is configured to retain an element in a particular position by engaging a base of said element, and wherein said first and second members are configured for cutting.

12. The signaling retention device according to claim 11, wherein said at least one signaling device includes a light source.

13. The signaling retention device according to claim 11, further comprising memory and a central processing unit.

14. The signaling retention device according to claim 11, further comprising at least one sensor.

15. The signaling retention device according to claim 11, further comprising at least one switch.

16. The signaling retention device according to claim 11, further comprising at least one camera.

17. The signaling retention device according to claim 11, further comprising a transceiver.

18. The signaling retention device according to claim 11, further comprising a microphone.

19. The signaling retention device according to claim 11, further comprising at least one impact tool.

20. The signaling retention device according to claim 11, further comprising at least one aromatic element.

* * * * *